US005259527A

United States Patent [19]

Gates

[11] Patent Number: 5,259,527

[45] Date of Patent: Nov. 9, 1993

[54] TANK SUPPORT AND CONTAINMENT SYSTEM

[76] Inventor: Robert J. Gates, 302 Juniper Ct., Yuma, Colo. 80759

[21] Appl. No.: 876,766

[22] Filed: May 1, 1992

[51] Int. Cl.[5] ..... F04B 45/02

[52] U.S. Cl. ..... 220/571; 220/23.83; 220/420; 220/4.2

[58] Field of Search ..... 220/571, 408, 400, 23.53, 220/23.86, 420, 4.12, 4.21

[56] References Cited

U.S. PATENT DOCUMENTS 4,960,222 10/1990 Fields, III ..... 220/571
5,012,948 5/1991 Van Den Bergh ..... 220/420
5,033,638 7/1991 Cruver et al. ..... 220/571
5,052,582 10/1991 Hall ..... 220/571
5,071,166 12/1991 Marino ..... 220/571

*Primary Examiner*—Joseph Man-Fu Moy

[57] ABSTRACT

A portable tank support and liquid containment system for a tank containing a liquid. The system includes (a) a basin having a floor and upright walls integral with the floor, and (b) support within the basin for supporting a tank above the floor in a stable and secure manner. Preferably the walls of the basin are double walls to better protect against loss of liquid in the event of a spill.

2 Claims, 5 Drawing Sheets

TANK SUPPORT AND CONTAINMENT SYSTEM

FIELD OF THE INVENTION

This invention relates to tank supports and liquid containment systems. More particularly, this invention relates to portable tank supports and liquid containment systems suitable for preventing escape of liquid chemicals and preventing contamination of soil, water and other environments.

BACKGROUND OF THE INVENTION

Various chemicals are commonly used in construction, agricultural and related fields, and in industrial fields. These chemicals may be fuel (e.g., gasoline or diesel fuel), lubricant (e.g., oil), pesticides, herbicides, etc. Some of such chemicals may comprise an organic medium (in the case of fuel or lubricant) or they may comprise organic or inorganic materials in an aqueous medium.

It is not always practical or convenient to store such liquid chemical materials in a permanent storage facility. For example, it is often necessary to locate a storage or holding tank in a remote location where it is needed on a temporary basis, after which the holding tank may be moved to a different remote location for another temporary period.

In recent years the need for secondary containment of liquids under or around storage tanks has grown tremendously. The Environmental Protection Agency, National Resource Districts, State Boards of Agriculture, and other governmental agencies have attempted to eliminate contamination of soil, water and other parts of the environment by requiring a secondary containment area or basin under or around fuel, pesticides, herbicides and other harmful liquid products that are stored in a primary holding tank or container.

It is possible to construct a permanent containment basin for a storage tank by means of providing large earthen berms or banks surrounding the tank and lining the resulting basin with plastic or other liquid impermeable material. The banks and the basin could also be constructed of concrete. However, neither of such approaches are suitable or practical for temporary storage facilities because of the cost of construction and the time required for constructing such containment basins. These techniques are best suited for containment of permanent, and large, storage tanks.

Some have used conventional open water tanks or the like for containment basins around and under small liquid holding tanks. However, this has various limitations. For example, the size of the holding tank which can be accommodated is limited by the size of the water tank. Further, the holding tank must somehow be lifted and placed into the open tank without spilling the contents, and then the holding tank must be secured in an upright manner to prevent it from tipping over in the open tank. Also, it is difficult and cumbersome to move the open tank when a liquid holding tank is positioned therein. Moreover, if the bottom of the holding tank is resting on the floor of the open tank, it is very difficult if not impossible to remove liquid material from the bottom of the holding tank. Yet another problem is presented if the open tank is punctured or has a hole or a broken seam in the floor wall areas. In such event, the open tank cannot function to contain spillage of liquid from the holding tank.

There has not heretofore been provided a portable tank support and liquid containment system having the advantages of the present invention.

SUMMARY OF THE PRESENT INVENTION

In accordance with the present invention there is provided a portable tank support and liquid containment system for a tank containing a liquid. The system, in one embodiment, comprises:

(a) a basin having a floor member and upright wall means integral with the floor member; and (b) support means within the basin for supporting the tank above the floor member.

Because the tank support and liquid containment system is portable, it can be easily moved from one location to another without disassembly and without interfering with the functions of the system. There is no need to construct an earthen berm or concrete bank. Rather, the containment system is entirely self-contained and may be used anywhere.

The containment system can be made in any size so as to accommodate and support any size of holding tank. The containment system can also be made to accommodate holding tanks of different shapes, and it can be made to accommodate multiple holding tanks.

The containment basin of the system may be composed of plastic (e.g., polypropylene), metal (e.g., aluminum, steel, or stainless steel), fiberglass, concrete, or composite materials. Any material may be used which is self-supporting and resistant to attack by the liquid material to be contained.

Preferably the walls of the containment basin comprise spaced-apart interior and exterior walls. This feature represents a significant improvement because there are two walls for containing any spilled liquid. Even if one of the walls should become punctured for any reason, the other wall will still contain the liquid and prevent it from leaking out and contaminating the soil or the ground water.

Other advantages of the portable tank support and liquid containment system of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

In FIGS. 1–4 there is shown a preferred embodiment of portable tank support and liquid containment system 10. A holding or storage tank 50 for liquid chemicals can be received and supported in one end of the containment basin 12 in an upright manner.

Figure 3:
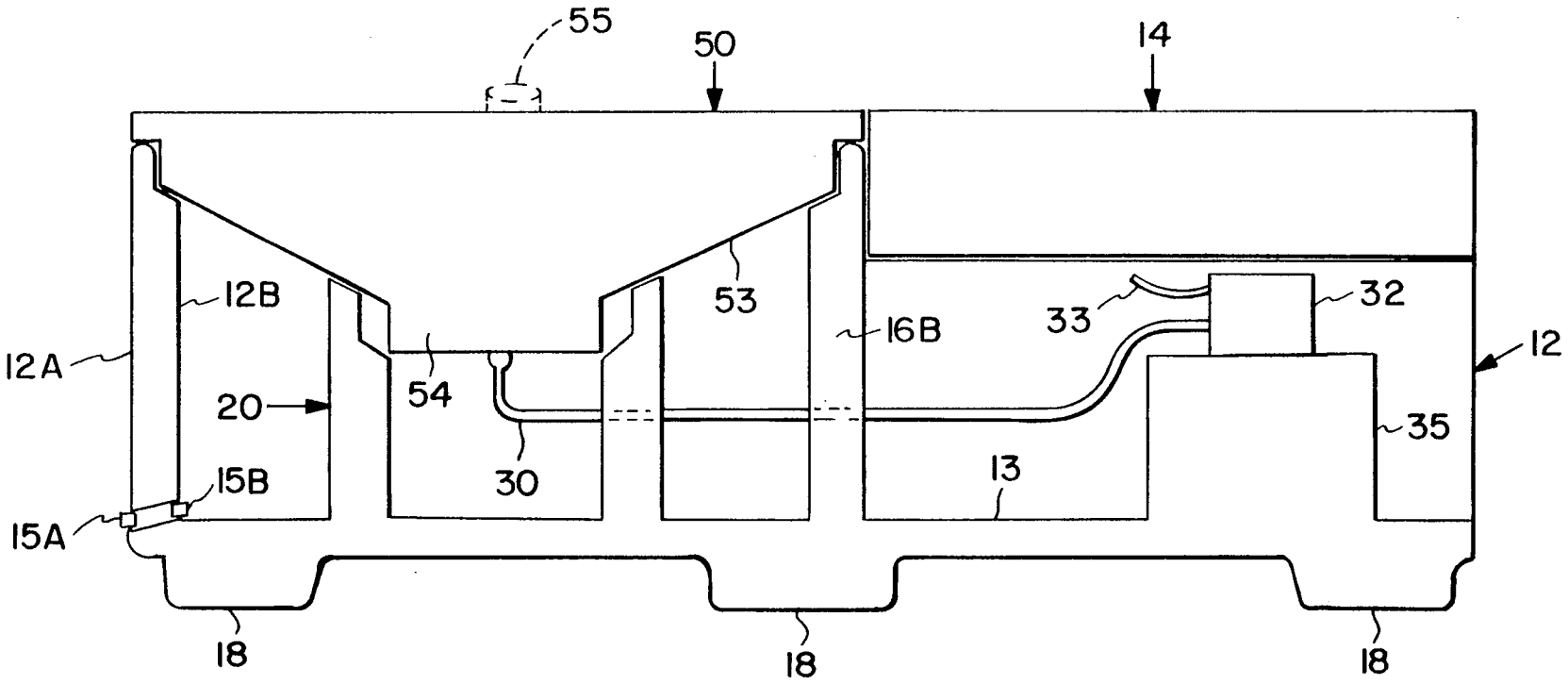
FIG. 3 is a cut-away view of the embodiment of FIG. 1 with a holding tank supported within the containment basin near one end thereof.
Figure 4:
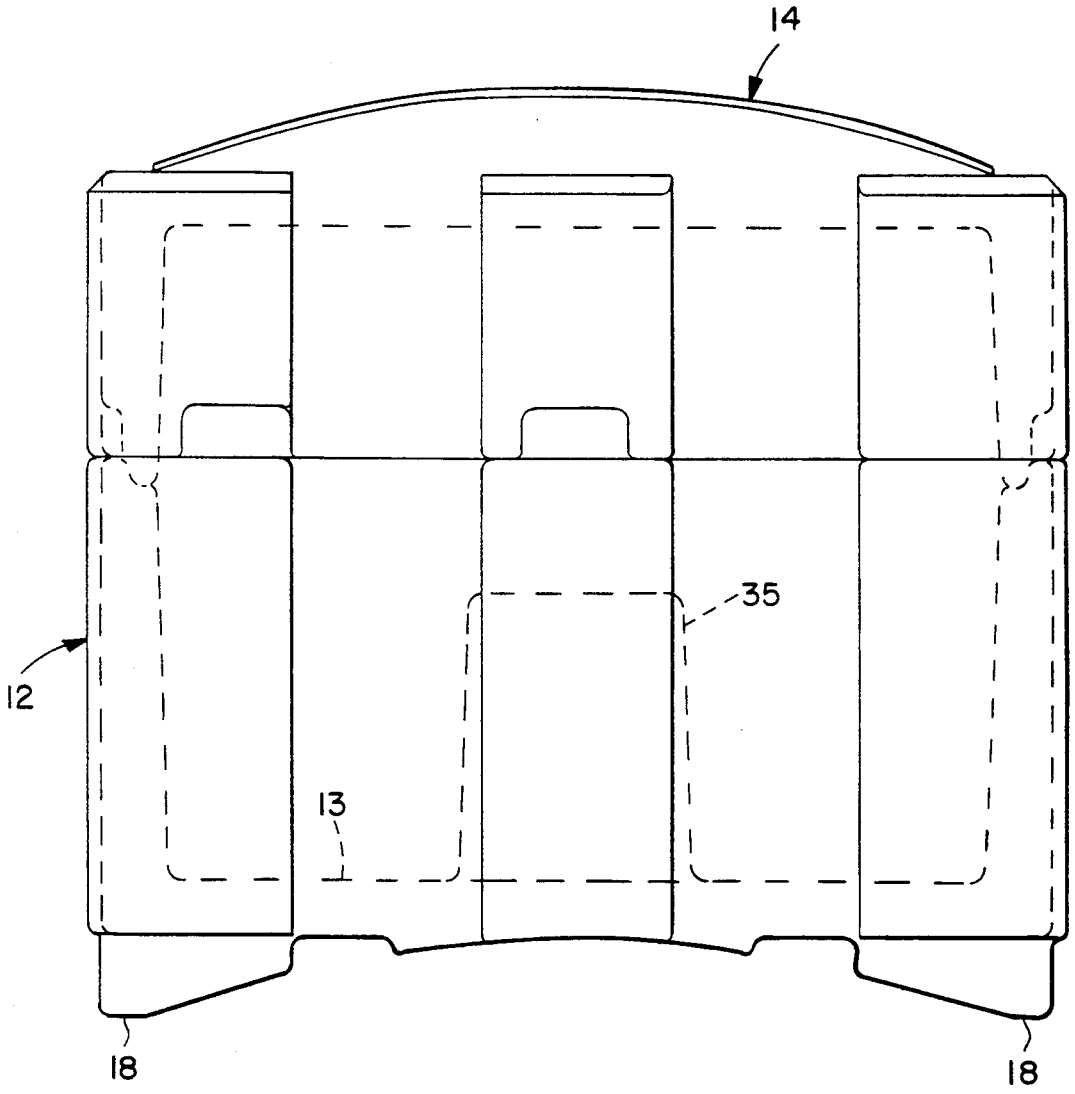
FIG. 4 is an end elevational view of the embodiment shown in FIG. 1.

The tank is an enclosed container having an openable lid or cover member 51 in the upper surface for filling the tank with the desired liquid material to be stored therein. Another cover 52 can be removed to allow a conventional mixing device 55 to be inserted into the tank. As illustrated, this type of tank includes a sloping side wall portion 53 and a circular lower portion 54. All the liquid in the tank drains down to the lower portion 54 as the tank is emptied. An opening in the base of the lower portion 54 may be connected to a hose 30 for taking liquid out of the tank when desired. The hose is preferably connected to a pump 32, as illustrated in FIG. 3. Liquid is then forced out through hose 33. The pump 32 preferably is supported on a platform or stand 35 which extends above the floor 13 of the basin 12.

In the event of a puncture of the tank 50, or a rupture or disconnection of hose 30, any liquid which is spilled will be safely contained within the basin 12. The pump 32 will not be immersed in the liquid because it is supported on the raised platform.

Preferably the pump is connected to a double injection line. An interior line made of plastic is protected by an outer hose. In the event the inner line ruptures, the outer hose will direct the liquid back to the containment basin.

The containment basin, as illustrated, comprises a floor member 13 and upright side walls which are integral with the floor. Preferably the side walls and the floor are molded plastic and are an integral unit. It is possible to provide separate side walls which are secured to a floor member, but such approach would then require sealing all joints to make the resulting structures liquid impervious.

The containment basin may be composed of any material which is liquid-impervious (or has been rendered liquid-impervious by means of coatings, sealants, or coverings). Suitable materials used for construction of the containment basin include, for example, plastic (e.g., polypropylene), metal, fiberglass, concrete, or composite materials.

Figure 5:
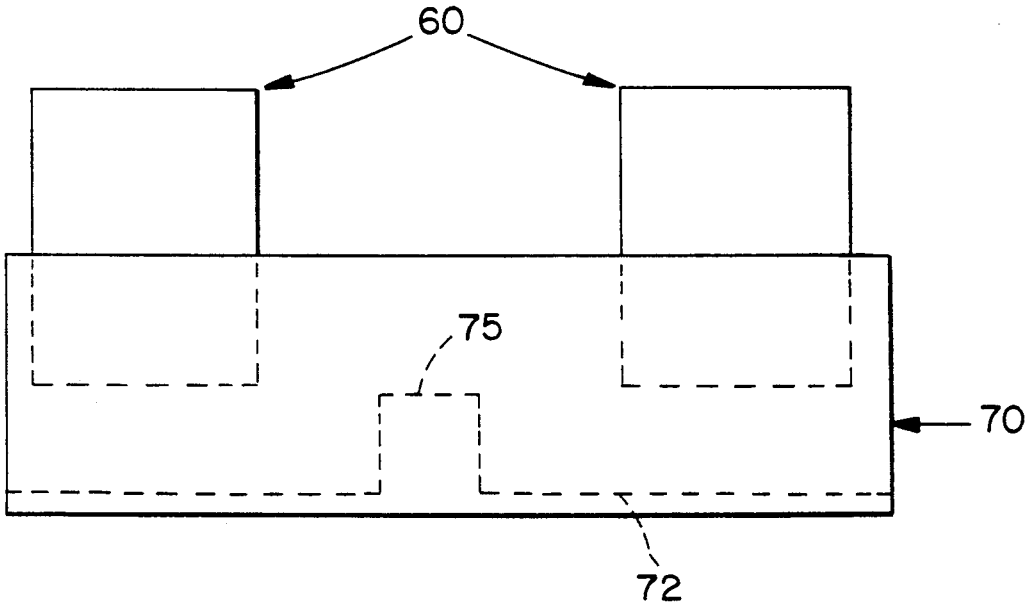
FIG. 5 is a side elevational view of another embodiment of tank support and liquid containment system of the invention.

The size and shape of the containment basin may vary, as desired. Also, the size and shape of the holding or storage tank may vary, as desired. For example, the holding tank may be circular, square, rectangular or any other cross-sectional shape. The tank may even have a shape, as shown in the drawings, which is a combination of various cross-sectional configurations. The volume or capacity of the tank may vary, for example, from a few gallons up to several hundred gallons, as desired. There may even be more than one tank supported in the containment basin (as illustrated in FIG. 5).

The capacity or volume of the containment basin is greater than the capacity or volume of the holding tank(s) so that any spilled chemical would be safely contained in the basin. Preferably the volume of the basin is at least 125% of the volume of the holding tank(s) and it may be as much as 200% or more of the volume of the tank(s).

Figure 6:
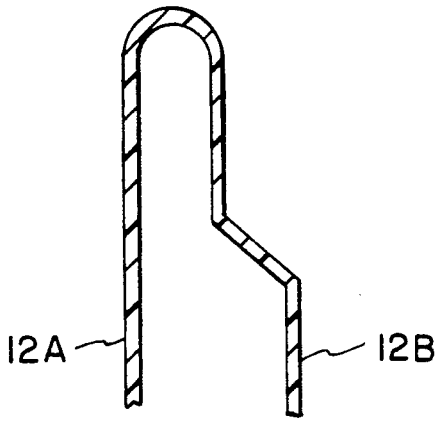
FIG. 6 is a cross-sectional view illustrating a preferred double-wall construction.

Preferably the containment basin is a double-walled structure with a cavity between the walls. In other words, each wall of the basin comprises spaced-apart interior and exterior wall portions 12A and 12B. This is illustrated in FIGS. 3 and 6. Thus, if there is a puncture or rupture of either wall portion for any reason, there is still another complete wall to contain the liquid and prevent spillage onto the ground or into the environment. This is a very significant advantage over previously used devices for containment basins. The floor also preferably comprises interior and exterior floor portions which are spaced-apart, as illustrated.

If desired, each wall portion may contain a removable plug or cap. This is illustrated in FIG. 3 where plug 15A fills an aperture in wall 12A and plug 15B fills an aperture in wall 12B. In the event of a rupture or leak in the tank or the hose, any spilled liquid can be drained from the basin after removing the two plugs. Removal of the plugs also facilitates cleaning of the basin.

Another advantage of providing the two plugs as shown herein is that the exterior plug can be removed and a hose or pipe fitting can be threadably secured in the aperture in the exterior wall. In the event of a spill in the basin the interior plug can be removed and the chemical can be drained safely through the apertures into an appropriate hose or pipe to another container.

Extending upwardly from the floor of the basin 12 are vertical support members for supporting the holding tank in a stable and secure upright manner above the floor of the basin. There may be several such support members, and they may vary in size and shape.

Figure 1:
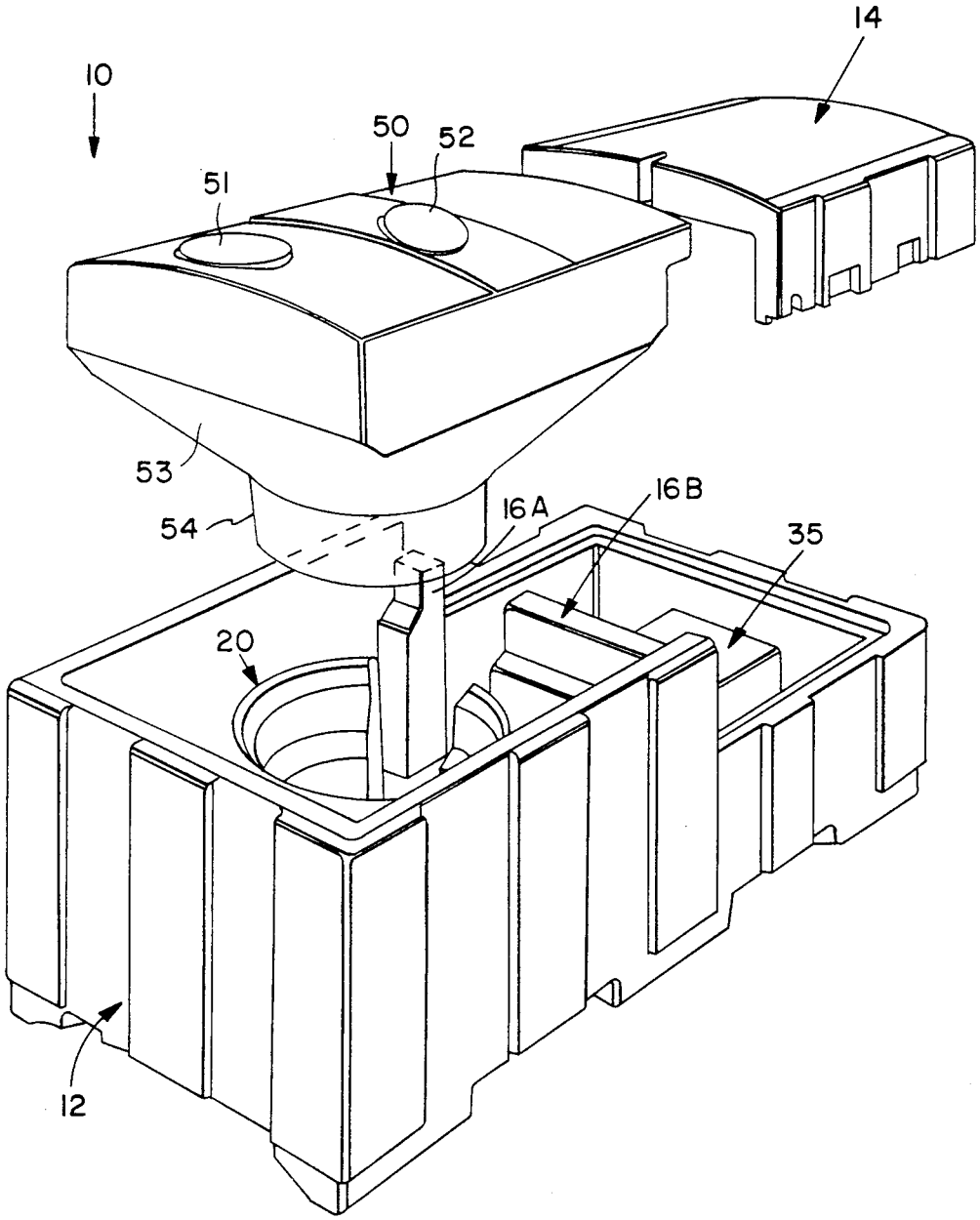
FIG. 1 is an exploded perspective view illustrating a preferred embodiment of tank support and containment system of this invention.
Figure 2:
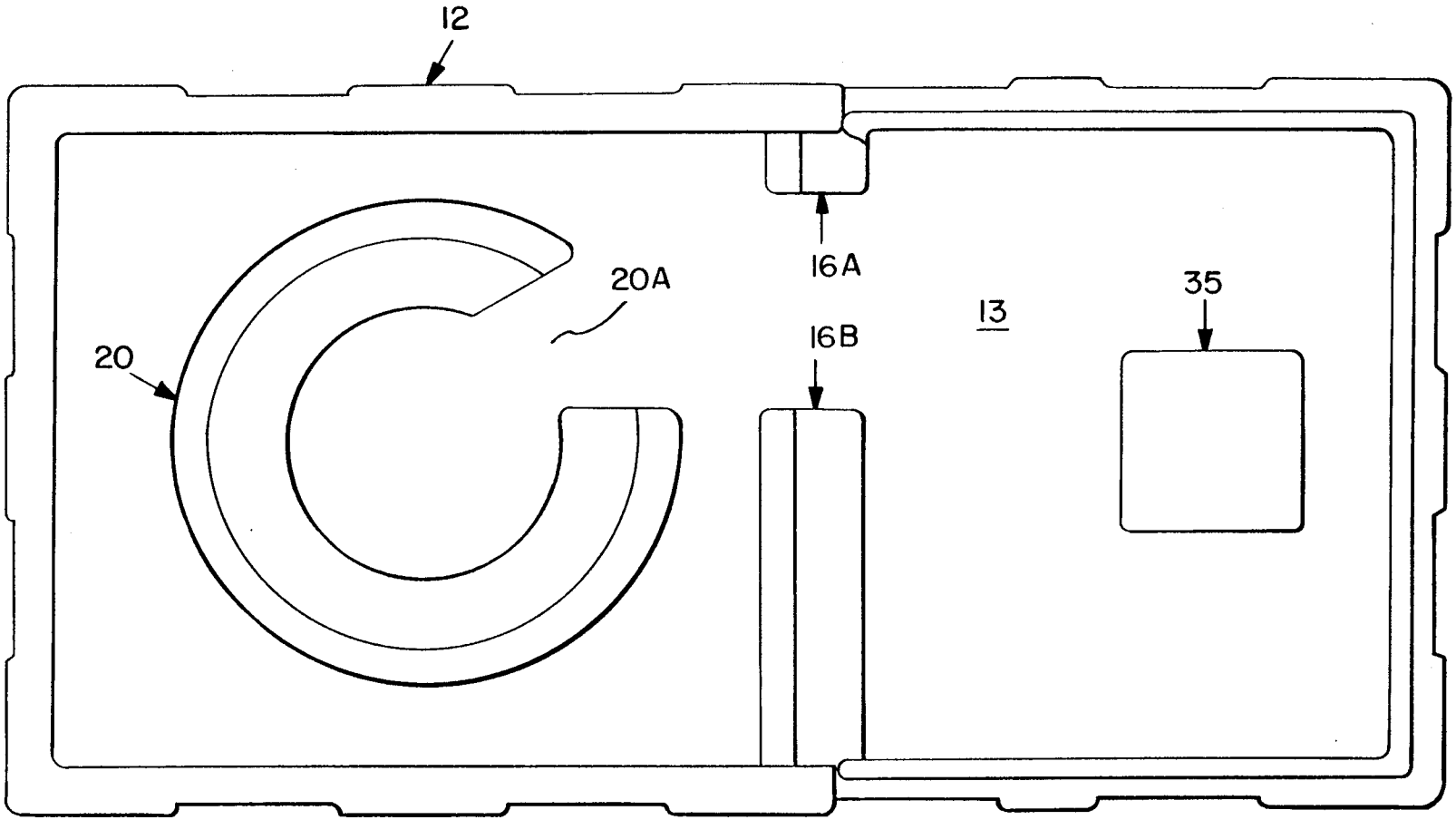
FIG. 2 is a top view of the embodiment shown in FIG. 1.

As best shown in FIGS. 1, 2 and 3, a preferred form of support member for a holding tank having a generally conical shape is a C-shaped member 20 which includes vertical support walls. The upper edge of these walls are sloped so as to be complementary to the sloped surfaces of the holding tank. The slot or opening 20A in the C-shaped support member enables a hose to extend from the underside of the holding tank to a pump supported on pedestal 35.

The end and side walls of the containment basin and intermediate wall portions 16A and 16B also help to support the weight of the holding tank. If desired, some or all of the support walls may include a ledge or shelf portion (as illustrated in the drawings) which is complementary to the exterior shape of the tank to assist in holding and supporting the tank in an upright stable position in the basin.

When the holding tank is supported above the floor of the basin in a stable and secure manner, as illustrated herein, the entire tank/containment basin assembly can be safely transported, lifted, etc. without danger of tipping the tank or puncturing the tank to allow spillage of chemical. However, even if the tank or the connected hose should leak, all chemical material would be safely contained within the containment basin.

Preferably the underside of the containment basin includes support legs 18 which are spaced-apart from each other. This arrangement is advantageous because it enables the forks of a conventional forklift to be placed beneath the basin (between leg members 18) for the purpose of lifting and carrying the basin (with or without the holding tank in place). For example, a forklift may be used to load the basin onto a truck or trailer, or to unload the basin from a truck or trailer. No manual lifting of the basin is required.

A removable cover member 14 can be positioned on top of the containment basin at one end to prevent dirt, debris, snow, rain, etc. from entering the basin. The cover also protects the pump and the associated plumbing in the basin. The tank itself covers the opposite end of the basin, as shown. The cover is supported by the walls of the basin.

FIG. 5 is a side elevational view illustrating two liquid holding tanks 60 supported in an upright manner in a containment basin 70. Raised support 75 is for the purpose of supporting a pump (which would be connected to each tank by means of appropriate hoses). The tanks are supported above the floor 72 of the basin to allow for drainage from the bottom of each tank.

The tank support and containment system of the invention is extremely portable and convenient to use. It is also effective and provides for safe containment of potentially dangerous chemical materials. The system can be safely used in remote areas and may be easily moved to another location on demand. Use of the system eliminates the need to construct permanent containment basins which may be used only periodically. The system of this invention also enables a tank containing chemicals to be moved safely without having to empty the tank.

Because the holding tank is supported above the floor of the containment basin, various drainage configurations may be used for removing liquid from the tank. For example, the bottom of the tank may be cone-shaped, flat, angled, round, cylindrical, etc. while still permitting a drain hose to be appropriately connected thereto for complete or nearly complete drainage of the liquid from the tank.

The floor of the containment basin is preferably horizontal, although for convenience in draining after a spill from the tank, the interior floor portion could be sloped toward one end. Also, a recessed channel could be included therein, if desired.

It is also possible to include handles or hand grips on the sides or ends of the containment basin to enable manual lifting where allowed by the weight of the system.

Other variants are possible without departing from the scope of this invention. For example, various valves, meters, calibration tubes, filters, etc. may be included for controlling the pumping of the liquid material. Also, various mechanical fastening systems may be used to secure the tank to the basin, if desired.

What is claimed is:

1. A portable tank support and liquid containment system for a tank containing liquid, said system comprising:

(a) a basin having a floor member and upright wall means integral with said floor member; wherein said upright wall means comprises spaced-apart interior and exterior wall members defining a closed cavity therebetween; wherein each of said interior and exterior wall members includes aperture means which can be selectively opened and closed to allow liquid in said basin to egress through said aperture means;

(b) support means integral with said basin for supporting said tank above said floor member; and wherein said support means comprises upstanding leg members supported by said floor member, (c) pump support means comprising a pedestal extending upwardly from said floor member; and (d) a removable cover member supported by said wall means.

2. A portable liquid containment system comprising:

(a) a basin having a floor member and upright wall means integral with said floor member; wherein said upright wall means comprises spaced-apart interior and exterior wall members defining a closed cavity therebetween;

(b) a tank for containing a liquid;

(c) support means integral with said basin for supporting said tank above said floor member; wherein said support means comprises upstanding leg members supported by said floor member; wherein said support means is generally C-shaped and includes vertical walls;

(d) pump support means comprising a pedestal extending upwardly from said floor member; and (e) a removable cover member supported by said wall means, wherein the volume of said basin is greater than the volume of said tank.

* * * * *